US008381795B2

(12) United States Patent
Cretegny et al.

(10) Patent No.: US 8,381,795 B2
(45) Date of Patent: Feb. 26, 2013

(54) APPARATUS FOR CASTING FILAMENTS

(75) Inventors: Laurent Cretegny, Niskayuna, NY (US); Bernard Patrick Bewlay, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 13/359,679

(22) Filed: Jan. 27, 2012

(65) Prior Publication Data

US 2012/0247705 A1 Oct. 4, 2012

Related U.S. Application Data

(62) Division of application No. 13/075,360, filed on Mar. 30, 2011, now Pat. No. 8,151,865.

(51) Int. Cl.
*B22D 11/00* (2006.01)

(52) U.S. Cl. ..... 164/423; 164/420

(58) Field of Classification Search ..... 164/457, 164/61, 493, 253–258, 65, 66.1, 68.1, 136, 164/462, 423, 420, 129, 135
See application file for complete search history.

(56) References Cited

U.S. PATENT DOCUMENTS

| | | | | |
|---|---|---|---|---|
| 3,234,606 | A | 2/1966 | Smith, Jr | |
| 3,955,612 | A * | 5/1976 | Schultheiss | 164/62 |
| 4,142,571 | A | 3/1979 | Narasimhan | |
| 4,154,283 | A | 5/1979 | Ray et al. | |
| 4,559,992 | A | 12/1985 | Bedell et al. | |
| 4,592,411 | A | 6/1986 | Bedell et al. | |
| 4,773,467 | A * | 9/1988 | Graham et al. | 164/122.1 |
| 4,982,780 | A | 1/1991 | Stepanenko et al. | |
| 5,335,711 | A | 8/1994 | Paine | |
| 6,148,899 | A * | 11/2000 | Cornie et al. | 164/65 |
| 6,253,828 | B1 | 7/2001 | Reiter | |
| 6,425,504 | B1 * | 7/2002 | Besser et al. | 222/593 |
| 6,539,620 | B1 | 4/2003 | Smashey | |
| 2006/0230984 | A1 * | 10/2006 | Bredt et al. | 106/690 |

OTHER PUBLICATIONS

Gjestland et al., "Advancements in High Pressure Die Casting of Magnesium", Advanced Engineering Materials, Sep. 20, 2007, vol. 9, Issue 9, pp. 769-776.

Niu et al., "Vacuum Assisted High Pressure Die Casting of Aluminium Alloys", Journal of Materials Processing Technology, Sep. 7, 2000, vol. 105, Issues 1-2, pp. 119-127.

* cited by examiner

*Primary Examiner* — Kevin P Kerns
*Assistant Examiner* — Steven Ha
(74) *Attorney, Agent, or Firm* — Richard A. DeCristofaro

(57) ABSTRACT

A casting apparatus is presented. The casting apparatus includes a first chamber and a second chamber. The first chamber includes a crucible and a sealed discharge outlet. The second chamber includes a casting mold for casting a plurality of filaments of a superalloy composition. The second chamber further includes a discharge inlet aligned with the sealed discharge outlet of the first chamber. The casting apparatus further includes a first port for applying a positive pressure to the first chamber and a second port for applying a vacuum to the second chamber. The sealed discharge outlet includes a hermetic seal comprising a material having a melting temperature equal to or greater than a melting temperature of the superalloy composition.

13 Claims, 5 Drawing Sheets

APPARATUS FOR CASTING FILAMENTS

CROSS-REFERENCE TO RELATED APPLICATIONS

This application is a divisional of U.S. patent application Ser. No. 13/075,360, filed Mar. 30, 2011, which is herein incorporated by reference.

BACKGROUND

The invention relates to a method and an apparatus for casting filaments of superalloys. More particularly, the invention relates to a method and an apparatus for casting filaments of superalloys using a high pressure differential furnace and mold system.

Weld wires are typically required for repair of aircraft components that have been in service for a period of time. The weld wires employed for repair of aircraft components include high performance alloys or superalloys, such as, for example, Rene 142, Rene N4, or Rene N5. These single crystal superalloy materials are directionally solidified and provide the advantages of increased strength and higher oxidation resistance in comparison to traditional alloys. However, the superalloy materials typically include a large number of alloying elements or metals, which makes these materials difficult to process into small diameter filaments employed as weld wires. Accordingly, using conventional casting techniques and systems, superalloy ingots having a minimum diameter of ~0.2 inches are typically produced. Further, superalloy ingots cast using conventional casting techniques typically include defects, such as, shrinkage, cold shuts, or cold laps.

These ingots may be then further processed using thermomechanical processing, such as, extrusion and swaging. This is followed by grinding or some other form of finishing or machining However, the thermomechanical processing approach is expensive, the cycle times are long, and sophisticated thermomechanical processing equipment may be required.

Thus, there is a need to provide a method and apparatus that allows for cost-effective and on-demand production of superalloy filaments or weld-wires. Further, there is a need to provide a method and apparatus for forming small diameter and high aspect ratio superalloy filaments or weld-wires having minimal defects.

BRIEF DESCRIPTION OF THE INVENTION

Embodiments of the present invention are provided to meet these and other needs. One embodiment is a method. The method includes providing a casting apparatus including a first chamber and a second chamber, wherein the first chamber is isolated from the second chamber. The method includes charging a superalloy composition into a crucible present in the first chamber and melting the superalloy composition in the crucible to form a molten superalloy composition. The method includes discharging the molten superalloy composition into a casting mold present in the second chamber; applying a positive pressure to the first chamber to create a first chamber pressure; and applying a vacuum to the second chamber to create a second chamber pressure, wherein the first chamber pressure is greater than the second chamber pressure. The method further includes casting at least one filament from the molten superalloy composition in the casting mold.

Another embodiment is a method. The method includes providing a casting apparatus including a first chamber and a second chamber, wherein the first chamber is isolated from the second chamber. The method includes charging a superalloy composition into a crucible present in the first chamber and melting the superalloy composition in the crucible to form a molten superalloy composition. The method includes applying a vacuum to the second chamber to create a second chamber pressure; discharging the molten superalloy composition into a multifilament casting mold present in the second chamber; applying a positive pressure to the first chamber to create a first chamber pressure, wherein the first chamber pressure is greater than the second chamber pressure. The method further includes, detecting an onset of the discharge of the molten superalloy composition into the casting mold, such that the positive pressure is applied to the first chamber at the onset of the discharge. The method furthermore includes casting a plurality of filaments from the molten superalloy composition in the multifilament casting mold.

Yet another embodiment is an apparatus. The casting apparatus includes a first chamber and a second chamber. The first chamber includes a crucible and a sealed discharge outlet. The second chamber includes a casting mold for casting a plurality of filaments of a superalloy composition. The second chamber further includes a discharge inlet aligned with the sealed discharge outlet of the first chamber. The casting apparatus further includes a first port for applying a positive pressure to the first chamber and a second port for applying a vacuum to the second chamber. The sealed discharge outlet includes a hermetic seal comprising a material having a melting temperature equal to or greater than a melting temperature of the superalloy composition.

DRAWINGS

These and other features, aspects, and advantages of the present invention will become better understood when the following detailed description is read with reference to the accompanying drawings, wherein.

DETAILED DESCRIPTION

As discussed in detail below, some of the embodiments of the invention provide a method and an apparatus for forming superalloy filaments. The filaments have a small diameter (less than about 0.1 inch) and a high aspect ratio (greater than about 40) and may be used as weld-wires for turbine component repair. The method and apparatus allow direct conversion of a large diameter ingot (typically greater than 1 inch diameter) into filaments having the required dimensions (diameter and aspect ratio) suitable to be used as a weld wire. Further, the weld-wire may be produced to size and on-demand in the component repair and rebuild shops, rather than having to rely on a vendor and their production schedule.

Furthermore, the method and apparatus of the present invention allow for low-cost manufacturing of the expensive superalloy weld-wires.

Approximating language, as used herein throughout the specification and claims, may be applied to modify any quantitative representation that could permissibly vary without resulting in a change in the basic function to which it is related. Accordingly, a value modified by a term or terms, such as "about", is not limited to the precise value specified. In some instances, the approximating language may correspond to the precision of an instrument for measuring the value.

In the following specification and the claims, the singular forms "a", "an" and "the" include plural referents unless the context clearly dictates otherwise.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances, an event or capacity can be expected, while in other circumstances the event or capacity cannot occur—this distinction is captured by the terms "may" and "may be".

Figure 3:
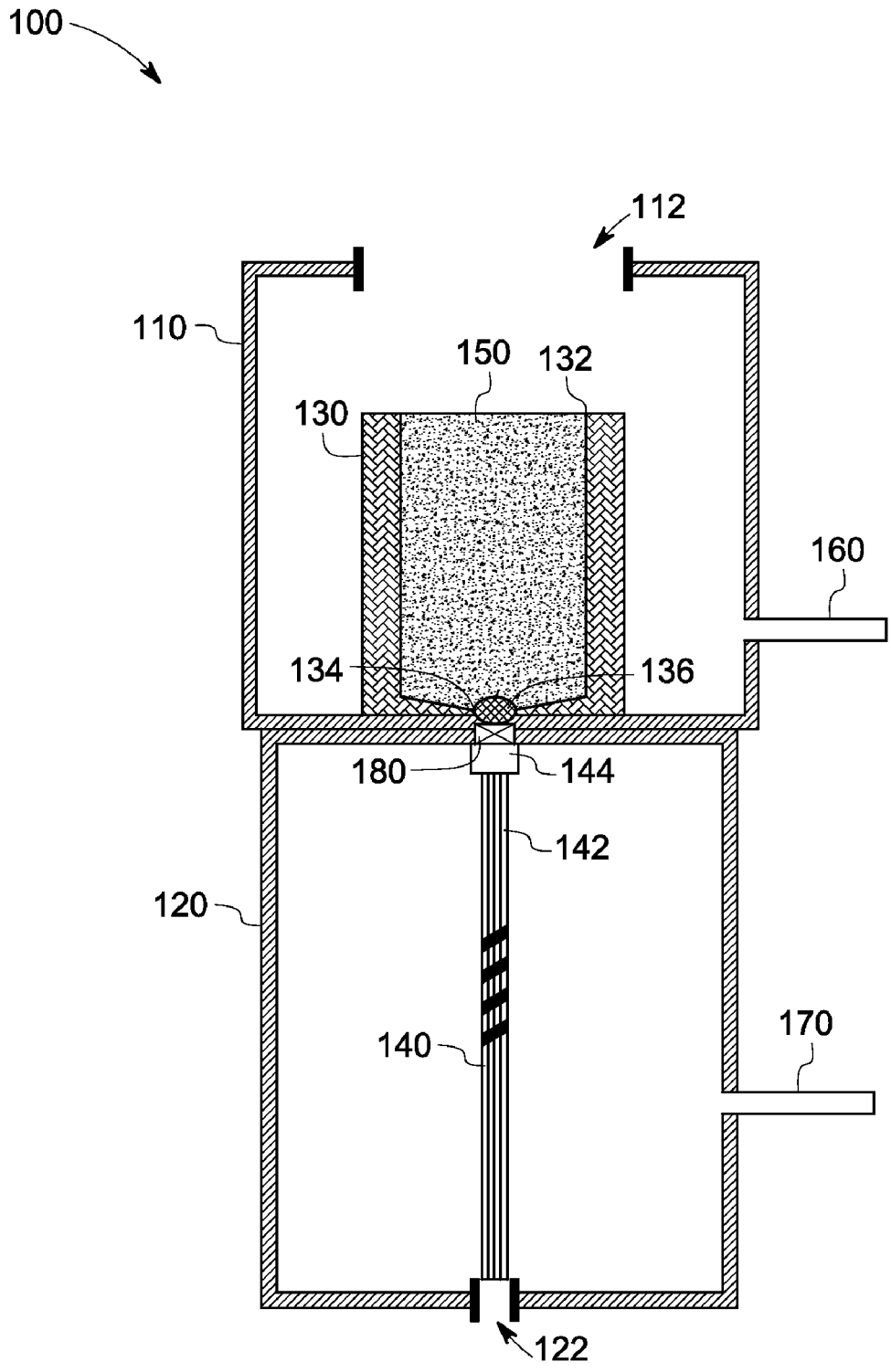
FIG. 3 is a schematic of an apparatus for casting a filament in accordance with one embodiment of the invention.

As discussed in detail below, some embodiments of the invention are directed to a method for casting filaments. The term "filament" as used herein refers to a thread or a wire having a substantially uniform diameter and an aspect ratio greater than about 40. The term aspect ratio as used herein refers to a ratio of filament length to the filament diameter. In one embodiment, the casting method 10 is described with reference to FIGS. 1 and 3, wherein at step 12, the method includes providing a casting apparatus 100 including a first chamber 110 and a second chamber 120. As indicated in FIG. 3, the first chamber 110 further includes a crucible 130 and the second chamber 120 includes a casting mold 140. The casting mold 140 as indicated in FIG. 3 may further include a plurality of components, for example, a plurality of filament molds forming a multifilament casting mold 140, as further shown in FIG. 5. In some embodiments, the first chamber further includes a first opening 112 for loading or unloading the crucible 130 into the first chamber 110. In some embodiments, the second chamber further includes a second opening 122 for loading or unloading the casting mold 140 into the second chamber 120.

In one embodiment, the first chamber 110 is isolated from the second chamber 120 during one or more steps in the casting process. In one embodiment, the first chamber 110 is isolated from the second chamber 120 with respect to flow of the superalloy material, that is, there no transfer of superalloy material from the first chamber 110 to the second chamber 120 during one of more of the casting process steps. In another embodiment, the first chamber 110 is isolated from the second chamber 120 with respect to pressure, that is, the first chamber may have a chamber pressure different from the chamber pressure in the second chamber. In yet another embodiment, the first chamber 110 is isolated from the second chamber 120 with respect to temperature, that is, the first chamber may have a temperature different from the chamber temperature in the second chamber. In one embodiment, the first chamber 110 and the second chamber 120 are isolated from each other at step 12 with respect to the flow of superalloy material, pressure, and temperature. In one embodiment, the first chamber 110 and the second chamber 120 may be isolated from each other using a gate, a valve, or combinations thereof, as indicated by 180 in FIG. 3.

Figure 1:
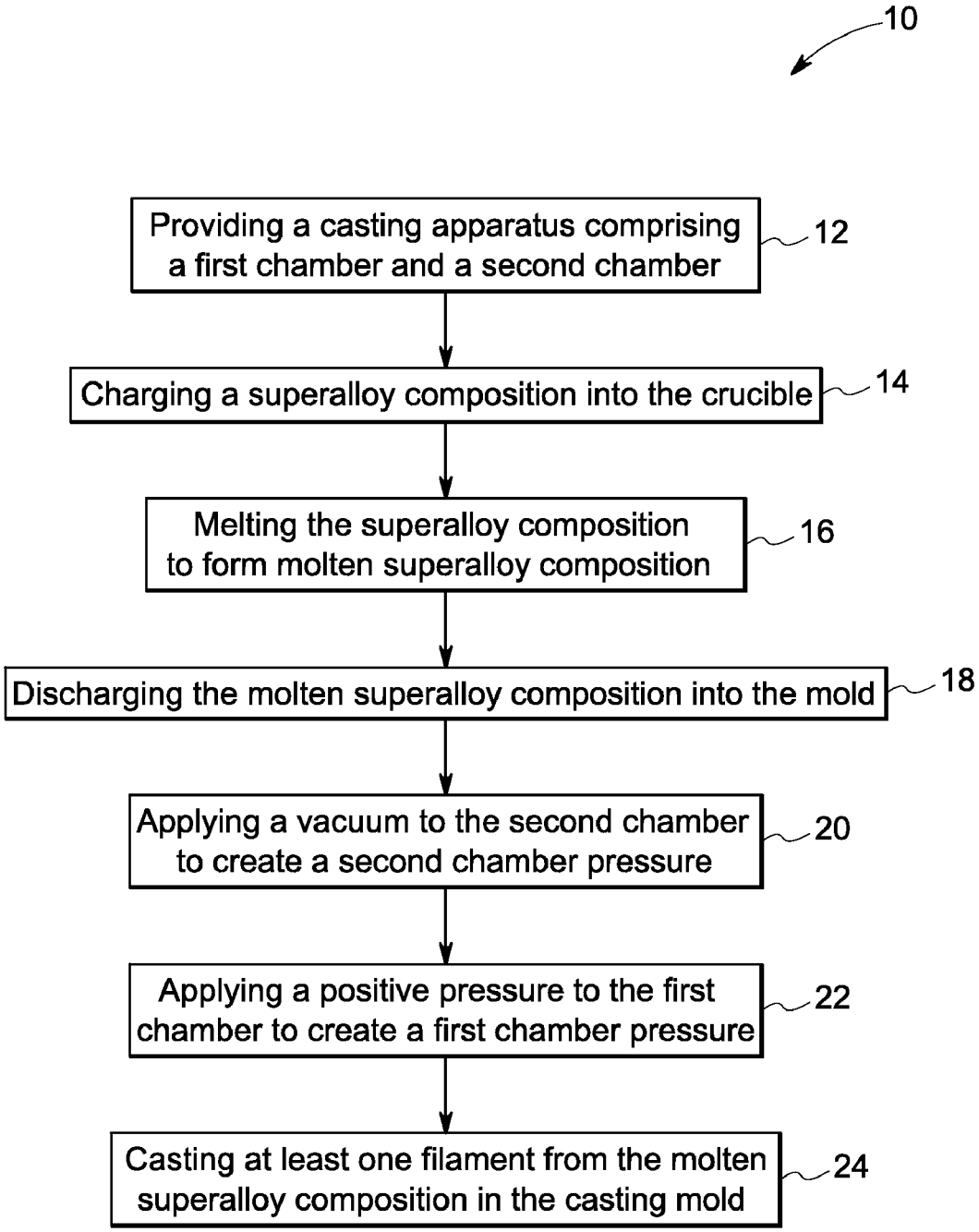
FIG. 1 illustrates a flow diagram of a method of casting a filament in accordance with one embodiment of the invention.

As indicated in FIGS. 1 and 3, the method further includes, at step 14, charging a superalloy composition into an interior volume 132 of the crucible 130 present in the first chamber 110. In some embodiments, the superalloy composition may be charged into the interior volume 132 via the first opening 112 in the first chamber. The term "superalloy" or "high-performance alloy" as used herein refers to an alloy that exhibits improved mechanical strength, creep resistance, surface stability, corrosion resistance, and oxidation resistance at high temperatures. Superalloys are metallic materials for service at high temperatures, particularly in the hot zones of gas turbines. Such materials allow the turbine to operate more efficiently by withstanding higher temperatures.

In one embodiment, the superalloy composition includes one or more of a base alloying metal, such as, for example nickel, cobalt, or nickel-iron. The superalloy composition further includes one or more additional metals, metalloids, or non-metals. Non limiting example of suitable metals, metalloids, or non-metals include chromium, cobalt, molybdenum, tungsten, tantalum, aluminum, titanium, zirconium, niobium, rhenium, carbon, boron, vanadium, hafnium, yttrium, rhenium, and combinations thereof.

In one embodiment, the superalloy composition includes a material suitable for use as weld-wires for repair of turbine components. In a particular embodiment, the superalloy composition is nickel-based. In one embodiment, the nickel-based superalloy composition further includes one or more of carbon, hafnium, tantalum, cobalt, chromium, molybdenum, tungsten, aluminum, rhenium, boron, zirconium, or titanium. In a particular embodiment, the superalloy composition includes Rene superalloys commercially available from General Electric, such as, for example, Rene 41, Rene 80, Rene 95, Rene 104, Rene 142, Rene N4, and Rene N5.

In one embodiment, the superalloy composition to be charged into the crucible 130 is in the form of a rod or an ingot. In one embodiment, the superalloy composition to be charged into the crucible 130 is in the form of an ingot having a diameter in a range greater than about 1 inch. In one embodiment, the ingot is placed directly into the crucible 130. In an alternate embodiment, the ingot is subjected to one or more processing steps, such as, partial melting before charging the superalloy composition into the crucible 130. As noted earlier, the first chamber 110 and the second chamber 120 are isolated from each other during the charging step 14. In one embodiment, the first chamber 110 and the second chamber 120 may be isolated from each other using a gate, a valve, or combinations thereof, as indicated by 180 in FIG. 3.

In one embodiment, the method further includes, at step 16, melting the superalloy composition in the crucible 130 to form a molten superalloy composition 150, as indicated in FIGS. 1 and 3. In one embodiment, the first chamber 110 further includes an induction heating system (not shown) and the step 16 of melting the superalloy composition in the crucible 130 includes heating the superalloy composition using the induction heating system. In one embodiment, the induction heating system may include induction heating coils employed to heat the crucible 130 and the superalloy composition. In one embodiment, the induction heating system may allow for partial levitation of the superalloy molten composition 150 away from the walls of the crucible 130 and the hermetic seal 136 at the base of the crucible 130. In one embodiment, the induction heating system may allow for rapid and efficient heating and melting of the superalloy composition without contamination from the crucible material. As noted earlier, the first chamber 110 and the second chamber 120 are isolated from each other during the melting step 16. In one embodiment, the first chamber 110 and the second chamber 120 may be isolated from each other using a gate, a valve, or combinations thereof, as indicated by 180 in FIG. 3.

In one embodiment, melting the superalloy composition in the crucible 130 includes heating the superalloy composition at a temperature in a range from about 1000° C. to about 1600° C. In another embodiment, melting the superalloy composition in the crucible 130 includes heating the superalloy composition at a temperature in a range from about 1200° C. to about 1500° C. In yet another embodiment, melting the superalloy composition in the crucible 130 includes heating the superalloy composition at a temperature in a range from about 1300° C. to about 1550° C. As noted earlier, the superalloy composition includes an alloy having a high melting temperature when compared to conventional casting metals, for example, gold, silver, or platinum. Accordingly, in some embodiments, the method and apparatus of the present invention allow for high temperature melting of superalloys and casting into filaments.

In one embodiment, the crucible 130 includes a material capable of withstanding the melting temperature of the superalloy composition. Further, in one embodiment, the crucible 130 includes a material that is sufficiently non-reactive with the superalloy composition. In one embodiment, the crucible 130 includes a refractory material. Refractory materials include non-metallic materials having chemical and physical properties applicable for structures, or as components of systems, that are exposed to environments above at least 1000° C. In one embodiment, the crucible 130 includes graphite, alumina, rare earth metals, or combinations thereof. In a particular embodiment, an alumina based crucible 130 is used for melting the superalloy composition.

As indicated in FIG. 3, the first chamber 110 and the crucible 130 further include a sealed discharge outlet 134. In one embodiment, the sealed discharge outlet 134 is aligned with a discharge inlet 144 present in the second chamber 120, as shown in FIG. 3. The sealed discharge outlet 134 prevents the flow of superalloy composition from the first chamber 110 to the second chamber 130 during the melting step and after the superalloy composition has completely melted.

In one embodiment, the sealed discharge outlet is sealed using a hermetic seal 136. In one embodiment, the hermetic seal 136 is in the form of a plug, a button, or a penny. In one embodiment, the hermetic seal 136 allows for controlled discharge of molten superalloy composition 150 from the crucible 130 to the casting mold 140. In one embodiment, the hermetic seal includes a material having a melting temperature equal to or greater than a melting temperature of the superalloy composition. Accordingly, the hermetic seal 136 is the last element of the charge to melt and makes the final seal between the first chamber 110 and the second chamber 120 prior to pouring the molten superalloy composition 150 into the casting mold 140.

In one embodiment, the hermetic seal 136 includes a material having a melting temperature greater than that of the superalloy composition. In an alternate embodiment, the hermetic seal 136 includes a material having a melting temperature similar to the melting temperature of the superalloy composition. In one embodiment, the hermetic seal includes a material having a melting temperature in a range from about 1300° C. to about 1600° C. In a particular embodiment, the hermetic seal 136 includes a material having the same composition as the superalloy composition.

Figure 4:
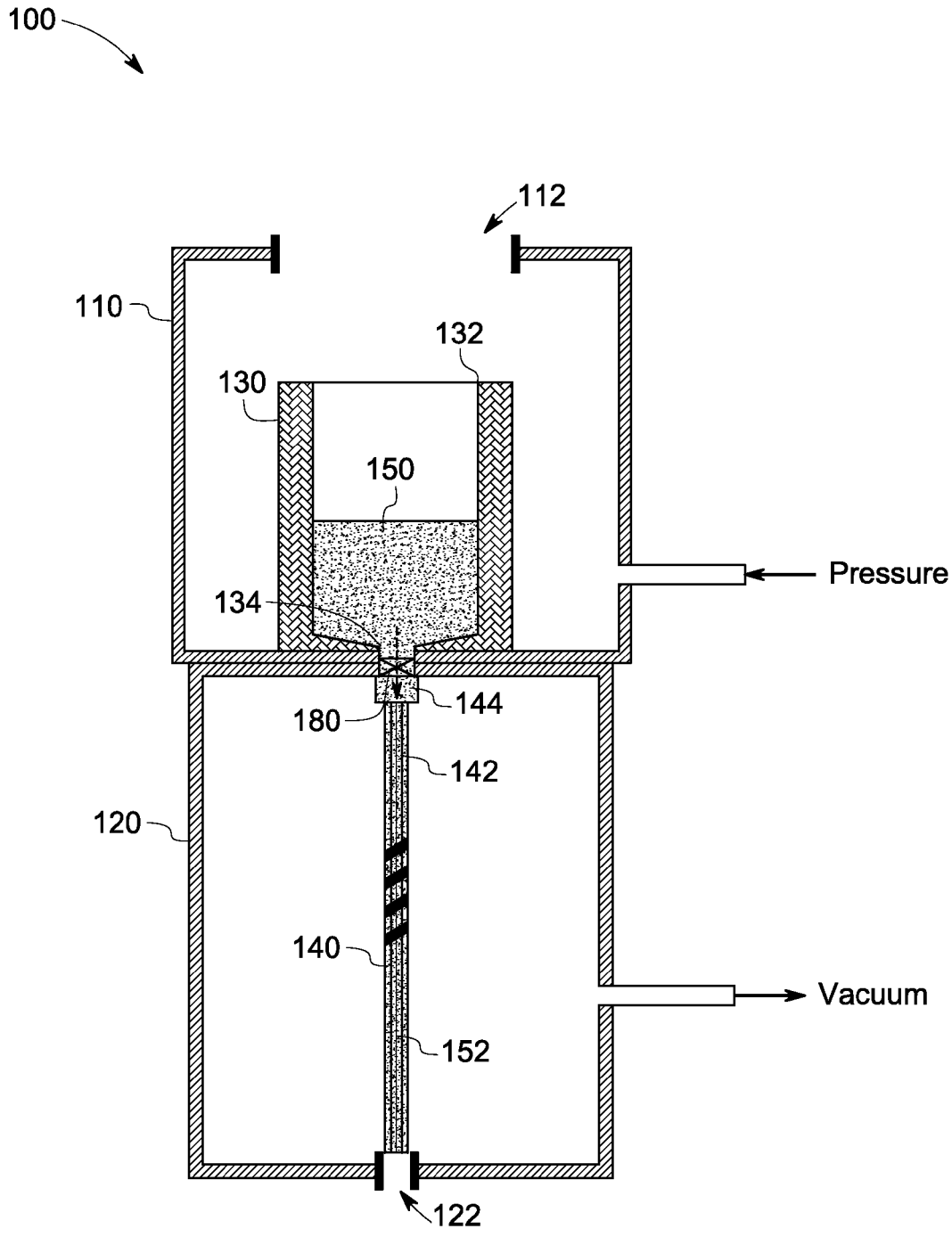
FIG. 4 is a schematic of an apparatus for casting a filament in accordance with one embodiment of the invention.

In one embodiment, the method further includes, at step 18, discharging the molten superalloy composition 150 into an interior volume 142 of the casting mold 140 present in the second chamber 120, as indicated in FIGS. 1 and 4. As noted earlier, the first chamber 110 and the second chamber 120 are isolated from each other during the charging step 14 and the melting step 16. In one embodiment, the gate or valve 180 isolating the first chamber 110 from the second chamber 120 is opened prior to discharging the molten superalloy composition 150 into the casting mold 140. As indicated by the arrow in FIG. 4, once the gate or valve 180 is opened the first chamber and the second chamber are in fluid communication with each other.

As indicated earlier, the crucible 130 includes a hermetic seal 136 that functions as the final seal between the crucible 130 and the casting mold 140. Accordingly, in some embodiments, once the hermetic seal is melted and broken, the molten superalloy composition 150 is discharged into the casting mold 140. The molten superalloy composition 150 that is discharged into the casting mold 140 accordingly further includes the molten hermetic seal 136 composition, in one embodiment. FIG. 4 illustrates a casting apparatus 100, wherein a portion of the molten superalloy composition 150 from the crucible 130 is discharged into the interior volume 142 of the casting mold 140. Accordingly, in one embodiment, the casting mold 140 includes a filament composition 152, wherein the filament composition includes the molten superalloy composition 150 and the molten hermetic seal material 136.

In one embodiment, the method further includes loading the casting mold 140 in the second chamber 120 prior to discharging the molten superalloy composition 150 into the casting mold 140. In another embodiment, the method further includes loading the casting mold 140 in the second chamber 120 prior to charging or melting the superalloy composition 150 in the crucible 130. In some embodiments, the casting mold 140 may be loaded in the second chamber 120 via a second opening 122 present in the second chamber.

In some embodiments, the casting mold 140 is pre-heated prior to loading the casting mold 140 in the second chamber 120. In some other embodiments, the casting mold 140 is heated after loading the casting mold 140 in the second chamber 120 and prior to discharging the molten superalloy composition 150 into the casting mold 140. In one embodiment, the second chamber 120 further includes a casting mold heater (not shown). In one embodiment, the casting mold 140 is heated to a temperature in a range greater than about 900° C., before onset of the discharge of the molten superalloy composition into the casting mold 140.

As noted earlier, the molten superalloy composition includes one or more reactive metals. Accordingly, in one embodiment, the casting mold 140 includes a material that is non-reactive with the molten superalloy composition. In one embodiment, the casting mold 140 includes a material selected from the group consisting of alumina, silica, mullite, and combinations thereof.

In one embodiment, the method further includes, at step 20, applying a vacuum to the second chamber 120 via second port 170 to create a second chamber pressure, as indicated in FIGS. 1 and 4. In some embodiments, the vacuum is applied to the second chamber 120 and the mold 140 prior to the onset of discharge of molten superalloy composition into the mold 140. In one embodiment, the second chamber 120 and the mold 140 may be evacuated using a vacuum pump (not shown). In one embodiment, the second chamber 120 and the mold 140 may be continuously subjected to vacuum conditions during the step of filling the mold 140, at step 18. In some other embodiments, the vacuum is applied to the first chamber 120 and the mold 140 at the onset of discharge of molten superalloy composition into the mold 140.

In one embodiment, the method further includes, at step 22, applying a positive pressure to the first chamber 110 via a port 160 to create a first chamber pressure, as indicated in FIGS. 1 and 4. In some embodiments, a positive pressure may be applied using a flow of inert gas, such as, for example, argon or helium. In some embodiments, the first chamber pressure is greater than the second chamber pressure thus creating a pressure differential between the first chamber 110 and the second chamber 120. In one embodiment, the pressure difference between the first chamber 110 and the second chamber 120 is greater than about 2 atm. In another embodiment, the pressure difference between the first chamber 110 and the second chamber 120 is greater than about 2.5 atm.

Without being bound by any theory, it is believed that the high pressure differential between the crucible 130 and the casting mold 140 provides very rapid filling of the casting mold 140. A rapid filling of the casting mold (typically less than 2 seconds) may be desirable because of the high surface area to volume ratio of the filament product. The high surface area to volume ratio provides very rapid cooling and solidification of the filament, and the rapid cooling may lead to generation of defects, such as, undesirable shrinkage, cold shuts, or cold laps. Further, the high surface area to volume ratio of filaments may lead to rapid cooling and solidification of the filament, and the rapid cooling may cause the mold cavity to be plugged or frozen shut before the filament cavity may be actually filled. In one embodiment, the high pressure differential employed provides for rapid filling and solidification of filaments, which may lead to minimization of defects and reduce the possibility of mold plugging.

Figure 2:
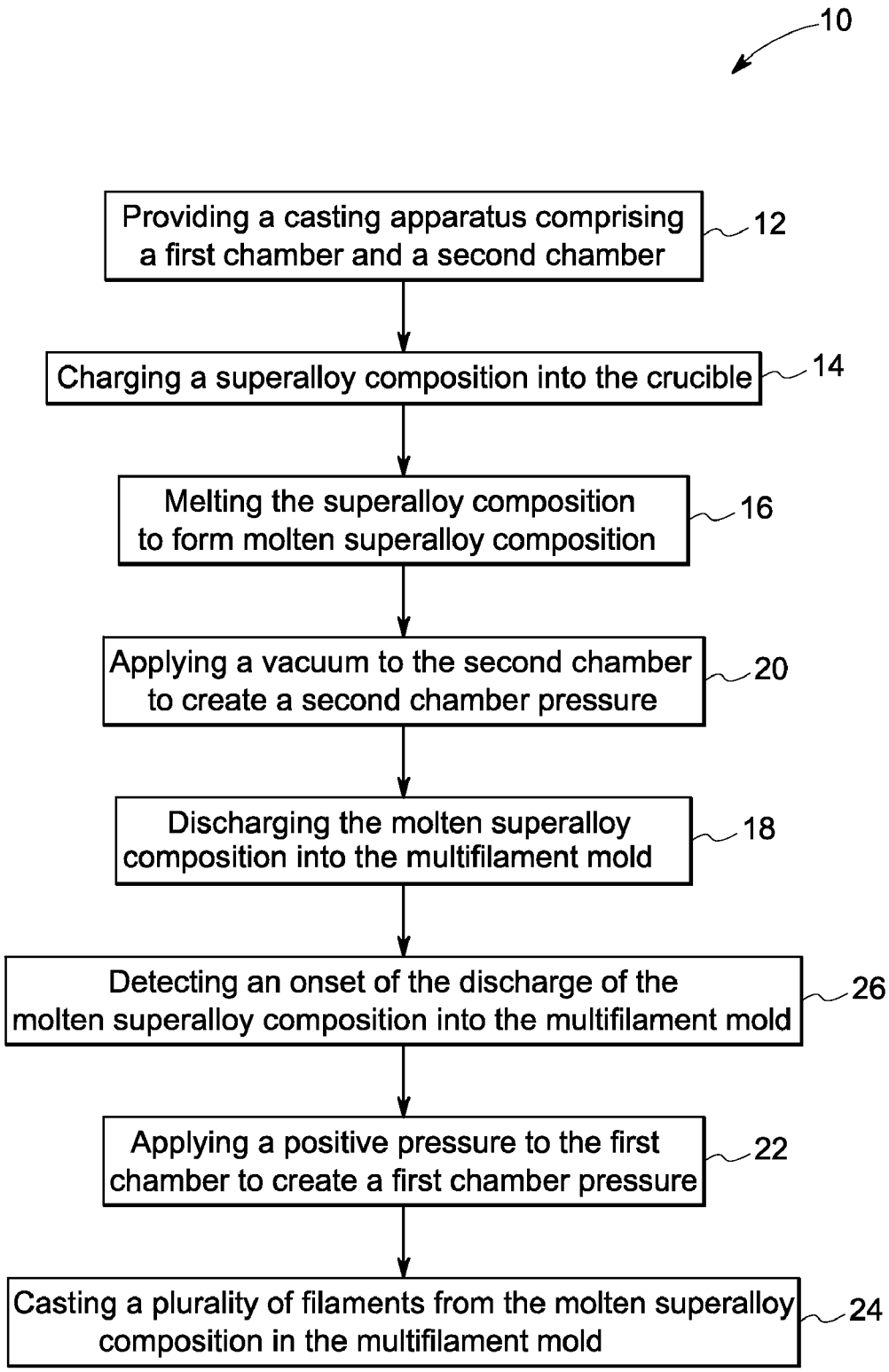
FIG. 2 illustrates a flow diagram of a method of casting a filament in accordance with one embodiment of the invention.

In one embodiment, as indicated in FIG. 2, the method further includes, at step 26, detecting an onset of the discharge of the molten superalloy composition into the casting mold 140 before applying the positive pressure to the first chamber 110, at step 22. Onset of discharge refers to the instant at which the hermetic seal 136 is completely melted and the molten superalloy composition 150 starts flowing from the discharge outlet 134 present into the crucible 130. In one embodiment, the positive pressure is applied to the first chamber 110 at the onset of the discharge of the molten superalloy composition 150 into the casting mold 140. In one embodiment, the onset of flow of molten superalloy composition out of the crucible 130 may be detected using a photocell and further trigger the application of a positive gas pressure to the first chamber 110.

In one embodiment, the step 18 of discharging the molten superalloy composition, step 20 of applying a vacuum to the second chamber, and step 22 of applying a positive pressure to the first chamber may be effected sequentially. In another embodiment, the step 18 of discharging the molten superalloy composition, step 20 of applying a vacuum to the second chamber, and step 22 of applying a positive pressure to the first chamber may be effected simultaneously.

In one particular embodiment, during the discharge of molten superalloy composition 150 from the crucible 130 and the filling of the casting mold 140, at step 18, the second chamber 120 is maintained under vacuum conditions and the first chamber 110 is subjected to a positive pressure to rapidly fill the casting mold 140. In one embodiment, a time duration for discharging the molten superalloy composition 150 into the casting mold 140 is in a range from about 0.05 seconds to about 120 seconds. In another embodiment, a time duration for discharging the molten superalloy composition 150 into the casting mold 140 is in a range from about 0.05 seconds to about 20 seconds. In a particular embodiment, a time duration for discharging the molten superalloy composition 150 into the casting mold 140 is in a range from about 0.05 seconds to about 2 seconds.

Without being bound by any theory, it is believed that timing of the application of gas pressure to force the molten superalloy composition into the cavity of the casting mold may affect casting process and the properties of the filaments formed. In one embodiment, the positive pressure is applied to superalloy composition when the charge is completely molten. If the charge is not fully molten and of a controlled superheat, the casting mold may not fill completely. Alternatively, if the charge is held too long in the molten state, the molten superalloy composition may react with the crucible or may be susceptible to contamination from atmospheric contaminants, which may adversely affect the properties of the filaments cast.

In one embodiment, the casting apparatus may further include one or more connection lines connected to a control for monitoring and detecting the onset of discharge of the molten superalloy composition from the crucible 130 into the casting mold 140. On detection of the onset of discharge by the control, a positive pressure may be applied to the first chamber 110 by introducing an inert gas into the chamber to maintain the desired pressure differential between the first chamber 110 and the second chamber 120. The application of positive pressure to the first chamber may be conducted manually or in an automated manner. The pressure differential between the first chamber 110 and the second chamber 120 may be maintained until the casting mold is completely filled with the molten superalloy composition, which may be further detected using a suitable detection mechanism.

In one embodiment, as indicated in FIGS. 1 and 3, the method further includes, at step 24, casting at least one filament from the filament composition 152 in the casting mold 140. As noted earlier, in one embodiment, the filament has an aspect ratio in a range greater than about 40. In another embodiment, the filament has an aspect ratio in a range greater than about 100. In another embodiment, the filament has an aspect ratio in a range greater than about 200. In yet another embodiment, the filament has an aspect ratio in a range from about 40 to about 400.

Figure 5:
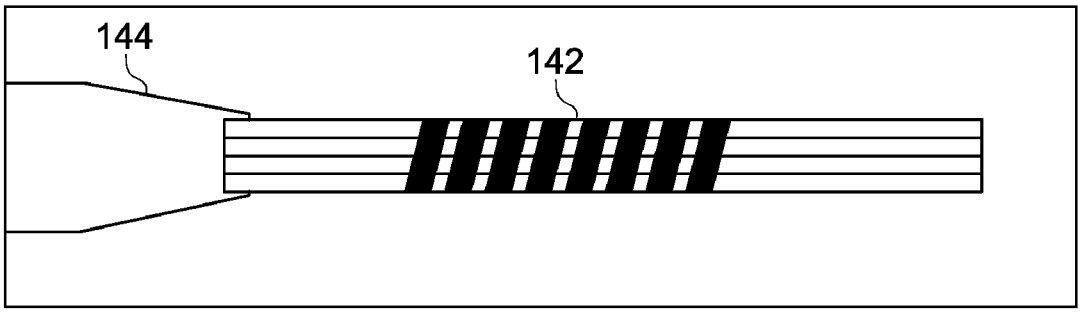
FIG. 5 is a schematic of an enlarged side-view of a multifilament casting mold in accordance with one embodiment of the invention.

In one embodiment, the filament has an average diameter in a range less than about 0.2 inches. In a particular embodiment, the filament has an average diameter in a range less than about 0.1 inches. Accordingly, the method and apparatus of the present invention advantageously allow for casting of thin-gauge filaments of superalloy materials directly from large diameter ingots (diameter greater than about 1 inch). Filaments of superalloy materials of these diameters and aspect ratios may not be commercially available using conventional casting techniques In one particular embodiment, the casting mold 140 includes a multifilament mold that allows for simultaneous casting of a plurality of filaments, as indicated in an enlarged view in FIG. 5. In FIG. 5, four different filament molds are illustrated by way of example; however, in some other embodiments the multifilament mold may include more than four molds. In one embodiment, a plurality of filaments may be cast using a single hermetic seal 134 in the first chamber 110. In an alternate embodiment, a plurality of hermetic seals 134 may be used to cast a plurality of filaments in a multifilament mold 140, each of the plurality of seals leading to a separate filament mold. In one embodiment, the method includes, at step 24, casting at least two filaments from the molten superalloy composition 152 in the casting mold 140. In one embodiment, the method includes, at step 24, casting at least four filaments from the molten superalloy composition 152 in the casting mold 140. In one embodiment, the method includes, at step 24, casting at least ten filaments from the molten superalloy composition 152 in the casting mold 140.

In some embodiments, the cast filaments may be further subjected to post-processing steps to minimize internal defects, such as, porosity and voids. Post-processing may be conducted using a suitable technique, such as, for example, extrusion, hot isotactic processing (HIP), heat treatment, and the like. In some embodiments, the plurality of filaments cast in the casting mold 140 may be removed via the second opening 122 in the second chamber 120.

In one embodiment, the filament may be used as a weld-wire for repair of turbine components. In some embodiments, the turbine components that may be repaired using the filaments or weld-wires include one or more of a turbine blade, a vane, or a shroud. In one embodiment, a superalloy ingot may be direct converted into a weld-wire having the required dimensions (diameter and aspect ratio) advantageously using the method and apparatus of the present invention on-site. Accordingly, the weld-wire may be produced to size and on-demand in the component repair and rebuild shops, rather than having to rely on a vendor and their production schedule. In some other embodiments, the weld-wires may be produced in a location remote from the repair site.

In one embodiment, a method is provided. With reference to FIG. 2, the method 10 includes providing a casting apparatus including a first chamber and a second chamber, wherein the first chamber is isolated from the second chamber, at step 12. The method includes charging a superalloy composition into a crucible present in the first chamber, at step 14 and melting the superalloy composition in the crucible to form a molten superalloy composition, at step 16. The method includes applying a vacuum to the second chamber to create a second chamber pressure, at step 20; discharging the molten superalloy composition into a multifilament casting mold present in the second chamber, at step 18; and applying a positive pressure to the first chamber to create a first chamber pressure, at step 22, wherein the first chamber pressure is greater than the second chamber pressure. The method further includes, detecting an onset of the discharge of the molten superalloy composition into the casting mold, at step 26, such that the positive pressure is applied to the first chamber at the onset of the discharge. The method furthermore includes casting a plurality of filaments from the molten superalloy composition in the multifilament casting mold, at step 24.

In one embodiment, a casting apparatus is provided as indicated in FIG. 3. The casting apparatus 100 includes a first chamber 110. The first chamber 110 includes a crucible 130 and a sealed discharge outlet 134. The casting apparatus further includes a second chamber 120. The second chamber 120 includes a casting mold 140 for casting a plurality of filaments of a superalloy composition. The second chamber 120 further includes a discharge inlet 144 aligned with the sealed discharge outlet 134 of the first chamber 110. The casting apparatus further includes a first port 160 for applying a positive pressure to the first chamber 110 and a second port 170 for applying a vacuum to the second chamber 120. The sealed discharge outlet 134 includes a hermetic seal 134 including a material having a melting temperature equal to or greater than a melting temperature of the superalloy composition.

Further, as indicated in FIG. 3, in some embodiments, the first chamber further includes a first opening 112 for loading or unloading the crucible 130 into the first chamber 110. In some embodiments, the second chamber further includes a second opening for loading or unloading the casting mold 140 into the second chamber 120.

In one embodiment, the first chamber 110 and the second chamber 120 are further connected to each other via a valve, a gate, or combinations thereof. As indicated in FIG. 3, the first chamber 110 and the second chamber 120 are connected via a valve 180. As noted earlier, the valve 180 may be closed when the first chamber 110 and the second chamber 120 have to be isolated from each other, for example, during loading of the superalloy composition in the crucible 130. The valve 180 may be opened when the first chamber 110 and the second chamber 120 have to be connected to each other, for example, during discharging of molten superalloy composition into the mold 140, as indicated by the arrow in FIG. 4.

The appended claims are intended to claim the invention as broadly as it has been conceived and the examples herein presented are illustrative of selected embodiments from a manifold of all possible embodiments. Accordingly, it is the Applicants' intention that the appended claims are not to be limited by the choice of examples utilized to illustrate features of the present invention. As used in the claims, the word "comprises" and its grammatical variants logically also subtend and include phrases of varying and differing extent such as for example, but not limited thereto, "consisting essentially of" and "consisting of." Where necessary, ranges have been supplied; those ranges are inclusive of all sub-ranges there between. It is to be expected that variations in these ranges will suggest themselves to a practitioner having ordinary skill in the art and where not already dedicated to the public, those variations should where possible be construed to be covered by the appended claims. It is also anticipated that advances in science and technology will make equivalents and substitutions possible that are not now contemplated by reason of the imprecision of language and these variations should also be construed where possible to be covered by the appended claims.

The invention claimed is:

1. A casting apparatus for casting a plurality of filaments, comprising:

a first chamber comprising a crucible and a sealed discharge outlet;

a second chamber comprising a multifilament casting mold for casting the plurality of filaments of a superalloy composition, and a discharge inlet aligned with the sealed discharge outlet of the first chamber, wherein the multifilament casting mold comprises a plurality of filament casting molds, and each of the plurality of filament casting molds comprises an interior volume defined by a shape that is representative of a filament;

a first port for applying a positive pressure to the first chamber; and a second port for applying a vacuum to the second chamber;

wherein the sealed discharge outlet comprises a hermetic seal comprising a material having a melting temperature equal to or greater than a melting temperature of the superalloy composition.

2. The casting apparatus as defined in claim 1, wherein the first chamber and the second chamber are further connected to each other via a valve, a gate, or combinations thereof.

3. The casting apparatus as defined in claim 1, wherein the first chamber further comprises a first opening for loading or unloading the crucible into the first chamber; and the second chamber further comprises a second opening for loading or unloading the multifilament casting mold into the second chamber.

4. The casting apparatus of claim 1, wherein the sealed discharge outlet comprises a hermetic seal comprising the superalloy composition.

5. The casting apparatus of claim 1, further comprising an induction heating system for heating and melting the superalloy composition in the crucible.

6. The casting apparatus of claim 1, wherein the casting mold comprises a material selected from the group consisting of alumina, silica, mullite, and combinations thereof.

7. The casting apparatus of claim 4, wherein the superalloy composition comprises a nickel-based superalloy, a cobalt-based superalloy, or combinations thereof.

8. The casting apparatus of claim 1, wherein the plurality of filaments comprises a weld-wire for repair of a turbine component.

9. The casting apparatus of claim 8, wherein the turbine component comprises a blade, a vane, shroud, or combinations thereof.

10. A casting apparatus for casting at least one filament, comprising:

a first chamber comprising a crucible and a sealed discharge outlet;

a second chamber comprising a discharge inlet aligned with the sealed discharge outlet of the first chamber, and a filament casting mold for casting the at least one filament of a superalloy composition, wherein the filament casting mold comprises an interior volume defined by a shape that is representative of a filament;

a first port for applying a positive pressure to the first chamber; and a second port for applying a vacuum to the second chamber;

wherein the sealed discharge outlet comprises a hermetic seal comprising a material having a melting temperature equal to or greater than a melting temperature of the superalloy composition.

11. A casting apparatus for casting at least one filament, comprising:

a first chamber comprising a crucible and a discharge outlet;

a second chamber comprising a discharge inlet aligned with the discharge outlet of the first chamber and a filament casting mold for casting the at least one filament of a superalloy composition, wherein the filament casting mold comprises an interior volume defined by a shape that is representative of a filament, and wherein the interior volume has an aspect ratio in a range greater than about 40;

a first port for applying a positive pressure to the first chamber; and a second port for applying a vacuum to the second chamber.

12. The casting apparatus of claim 1, wherein the interior volume has an aspect ratio in a range greater than about 40.

13. The casting apparatus of claim 1, wherein the sealed discharge outlet comprises a hermetic seal comprising a material having a melting temperature in a range from about 1000° C. to about 1600° C.

* * * * *